US005957395A

United States Patent [19]

Howe et al.

[11] Patent Number: 5,957,395

[45] Date of Patent: Sep. 28, 1999

[54] SAFE CHARGING

[75] Inventors: Varce E. Howe, Zionsville, Ind.; David R. Huff, Santa Rosa Beach, Fla.

[73] Assignee: Illinois Tool Works Inc., Glenview, Ill.

[21] Appl. No.: 08/955,039

[22] Filed: Oct. 21, 1997

[51] Int. Cl.[6] ..... B05B 5/04

[52] U.S. Cl. ..... 239/691; 239/703

[58] Field of Search ..... 239/691, 699, 239/700, 701, 703, 708

[56] References Cited

U.S. PATENT DOCUMENTS

| | | | |
|---|---|---|---|
| 3,815,820 | 6/1974 | Probst . | |
| 4,148,932 | 4/1979 | Tada et al. . | |
| 4,275,838 | 6/1981 | Fangmeyer . | |
| 4,611,762 | 9/1986 | Turner et al. | 239/708 |
| 4,887,770 | 12/1989 | Wacker et al. . | |
| 5,078,321 | 1/1992 | Davis et al. . | |
| 5,137,215 | 8/1992 | Degli . | |
| 5,622,563 | 4/1997 | Howe et al. . | |
| 5,632,448 | 5/1997 | Alexander et al. . | |
| 5,633,306 | 5/1997 | Howe et al. . | |
| 5,662,278 | 9/1997 | Howe et al. . | |

OTHER PUBLICATIONS

Approval Standard Factory Mutual Research Corporation, Electrostatic Finishing Equipment Class No. 7260, Mar. 1996.

*Primary Examiner*—Andres Kashnikow
*Assistant Examiner*—Sean P. O'Hanlon

[57] ABSTRACT

An atomizing apparatus comprises an electrode, an orifice through which coating material to be atomized is discharged, and a power supply for maintaining across the electrode and an article to be coated by coating material dispensed from the apparatus a potential for transferring electrical charge to the material to be atomized to cause the material to be attracted toward the article. The apparatus has a first surface providing a locus for electrical discharge when the potential is maintained on the electrode. At least one first resistance has first and second terminals adjacent the first surface and the electrode, tending to localize the discharge at the first surface to the first terminal.

23 Claims, 3 Drawing Sheets

FIG. 1
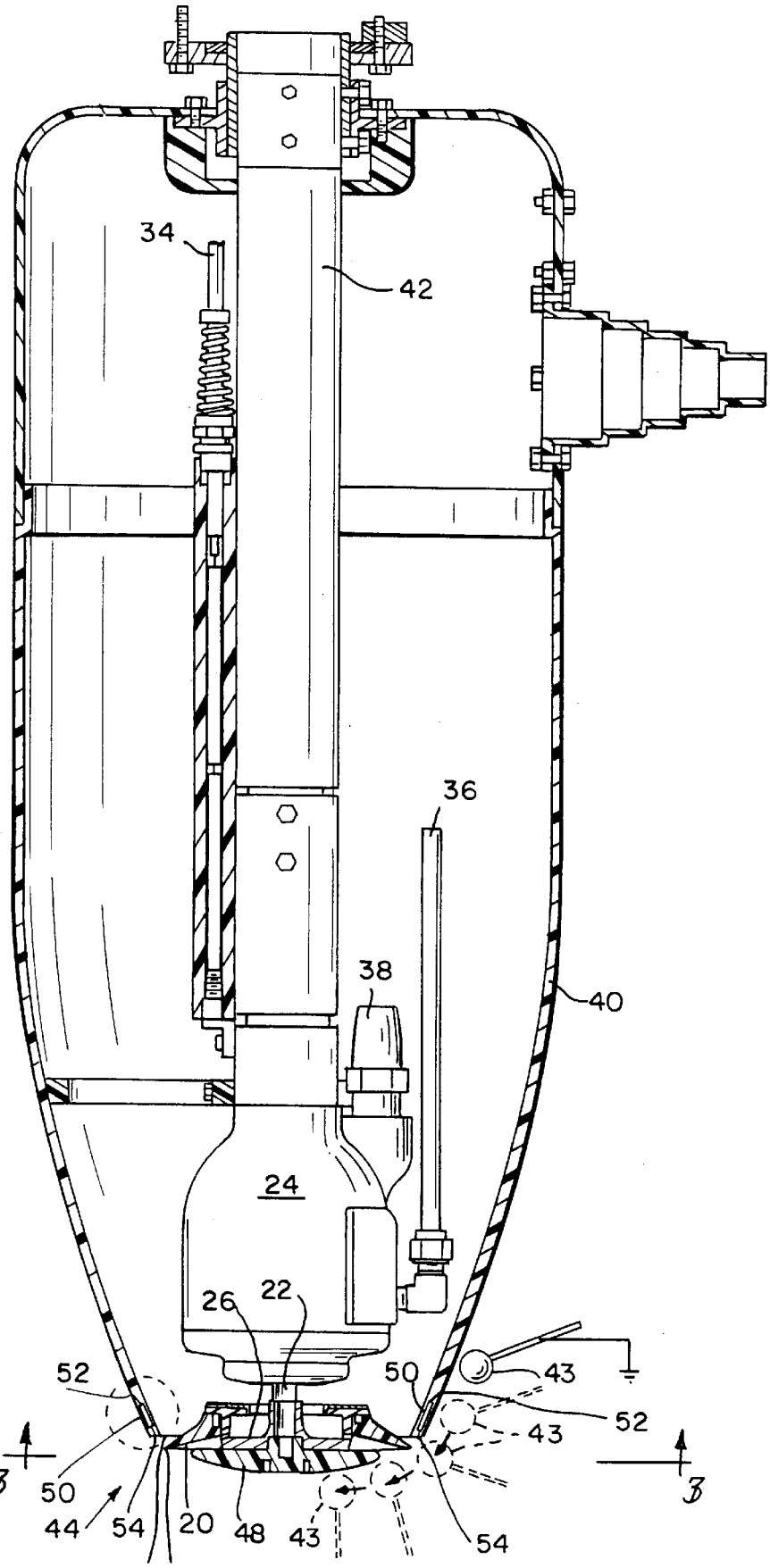
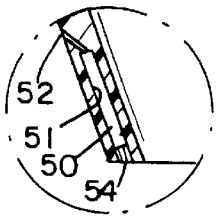
FIG. 5

SAFE CHARGING

BACKGROUND OF THE INVENTION

This invention relates to electrostatically aided atomization and coating of articles with charged particles. It is disclosed in the context of certain types of coating material dispensers. However, it is believed to be useful in a wide range of coating dispensing applications. As used in this application, terms such as "electrically conductive" and "electrically non-insulative" refer to a broad range of conductivities electrically more conductive than materials described as "electrically non-conductive" and "electrically insulative." Terms such as "electrically semiconductive" refer to a broad range of conductivities between electrically conductive and electrically non-conductive. "Cylindrical surface" is used in its mathematical sense, namely, to describe a surface generated by a straight line moving always parallel to another straight line.

In its early years, the field of electrostatically aided coating material atomization and dispensing was dominated by the dispensing of coating materials containing organic solvents. These solvents and the coating materials they carried typically were electrically non-conductive or only very slightly conductive, but the carriers or solvents were also relatively volatile. The particles of these coating materials thus could ordinarily be charged by contact with, or at least passage within relatively short distances of, electrodes maintained at relatively high magnitude potentials with respect to the article(s) to be coated by the atomized coating material particles. However, care needed to be taken not to stimulate high energy electrical discharge across the space between the electrodes and the article(s) being coated. This need dictated considerable attention by operators of such equipment. The volatility of these solvents also raised environmental concerns about the release of so-called voc's (volatile organic compounds).

Efforts have continued to enhance solvent based coating systems, both against the hazards associated with having relatively high magnitude electrical potentials across atmospheres containing voc's, and against the inevitable close proximity of operators to the highly charged electrodes of such equipment. Standards for testing such equipment have been promulgated by a number of testing agencies in various countries. Illustrative of such standards is the Electrostatic Finishing Equipment Approval Standard, Class Number 7260, promulgated by Factory Mutual Research Corporation (the FM standard).

The FM standard includes protocols for the testing of both manual equipment (for example, hand held coating atomizing and dispensing guns—the FM standard, chapter 5) and automatic equipment (for example, atomizers mounted on robot arms—the FM standard, chapter 6). Among the tests in both cases is a test in which the equipment at operating voltage is probed using a grounded metal sphere having a diameter of one inch (about 2.5 cm). This test takes place in an explosive atmosphere of propane in air. An explosion is a failed test. To achieve FM approval, the equipment must, inter alia, pass this test. The FM standard has caused considerable research and improvement in the safety of electrostatic coating systems.

DISCLOSURE OF THE INVENTION

This invention relates to such an improvement. According to the invention, an atomizing apparatus comprises a rotator having a conductive output shaft, and an atomizer for mounting on the output shaft. The atomizer includes an electrode coupled to the output shaft when the atomizer is mounted on the output shaft for transferring charge from the output shaft to coating material to be atomized by the apparatus, and an orifice through which coating material to be atomized is discharged so that the coating material flows across the electrode and is charged. A power supply maintains across the electrode and an article to be coated by the atomized coating material a potential for transferring charge to the coating material to cause the coating material to be attracted toward the article. The atomizer has a first, concave, somewhat cup-shaped surface. At least one first resistance has a first terminal adjacent the first surface and a second terminal adjacent at least one of the output shaft and the electrode.

According to illustrative embodiments, the first surface comprises a non-conductive first surface.

Additionally according to illustrative embodiments, the first surface includes a discharge edge from which the electrically charged material is atomized and discharged. A shroud houses the rotator. The shroud includes a second surface. An inner edge of the second surface defines an opening through which at least a portion of the atomizer including the discharge edge extends. The shroud further includes a third surface. At least one second resistance has a first terminal adjacent the second surface and a second terminal adjacent the third surface.

According to illustrative embodiments, the atomizer further comprises a fourth, convex, somewhat bell-shaped, electrically non-conductive surface. At least one second resistance includes a first terminal adjacent the fourth surface and a second terminal adjacent at least one of the output shaft and the electrode.

According to an illustrative embodiment, a coating material atomizing gun comprises an electrode, an orifice through which coating material to be atomized is discharged past the electrode so that the coating material is charged, a power supply for maintaining across the electrode and an article to be coated by the atomized coating material a potential for transferring charge to the coating material to cause the coating material to be attracted toward the article, a somewhat cylindrical first surface generally around and adjacent the orifice and the electrode, and at least one first resistance including a first terminal adjacent the first surface and a second terminal adjacent at least one of the orifice and the electrode.

According to another illustrative embodiment, an atomizing apparatus comprises a rotator having a conductive output shaft, and an atomizer for mounting on the output shaft. The atomizer includes an electrode coupled to the output shaft when the atomizer is mounted on the output shaft for transferring charge from the output shaft to coating material to be atomized by the apparatus. The apparatus further includes an orifice through which coating material to be atomized is discharged so that the coating material flows across the electrode and is charged, and a power supply for maintaining across the electrode and an article to be coated by the atomized coating material a potential for transferring charge to the coating material to be attracted toward the article. The atomizer has a first, concave, somewhat cup-shaped surface adjacent the electrode across which the coating material flows. The first surface includes a discharge edge from which the electrically charged coating material is atomized and discharged. A nut is provided for mounting the atomizer on the output shaft. The nut has a first side substantially enclosing the first surface and the electrode except for the discharge edge of the first surface when the nut is in position on the shaft retaining the atomizer thereon and a second side generally opposite the first side. At least one first resistance has a first terminal adjacent the second side and a second terminal adjacent at least one of the output shaft and the electrode.

Illustratively, the at least one resistance comprises at least one lumped resistor.

Alternatively, illustratively, the at least one resistance comprises electrically non-insulative material, and at least one resistance passageway. The electrically non-insulative material is provided in the at least one resistance passageway.

BRIEF DESCRIPTION OF THE DRAWINGS

The invention can best be understood by referring to the following detailed description and accompanying drawings which illustrate the invention. In the drawings:

FIG. 1 illustrates a partial longitudinal sectional view of an apparatus constructed according to the present invention;

FIG. 5 illustrates an enlarged fragmentary view of a detail of FIG. 1;

DETAILED DESCRIPTIONS OF ILLUSTRATIVE EMBODIMENTS

Figure 2:
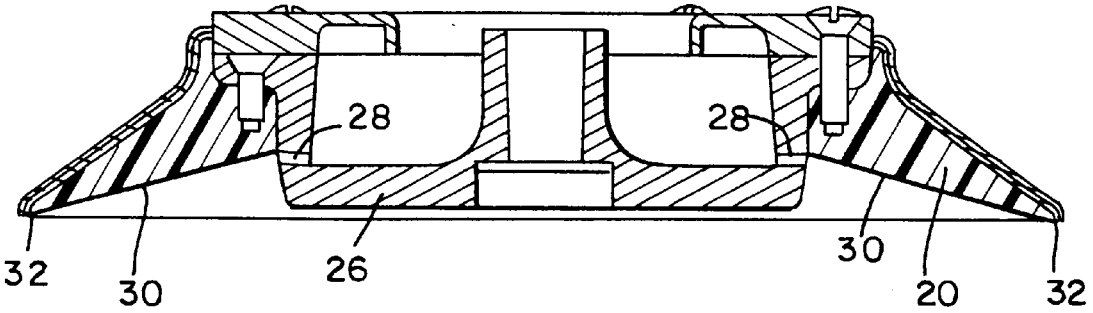
FIG. 2 illustrates an enlarged longitudinal sectional view of a detail of the apparatus illustrated in FIG. 1.
Figure 3:
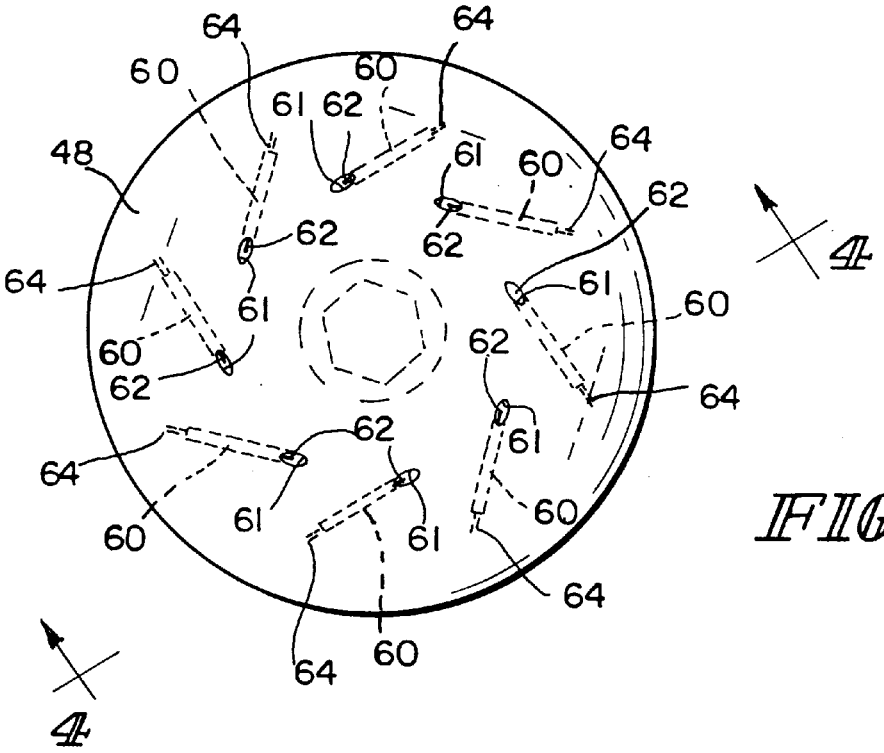
FIG. 3 illustrates an enlarged end elevational view of a detail of the apparatus illustrated in FIG. 1, taken generally along section lines 3—3 of FIG. 1.
Figure 4:
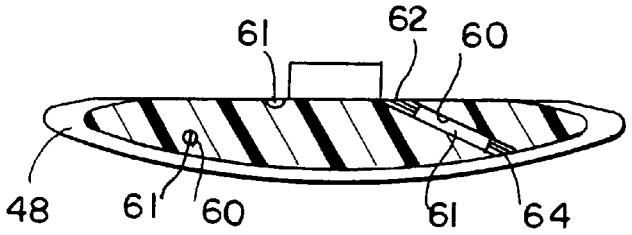
FIG. 4 illustrates an enlarged sectional view of the detail illustrated in FIG. 3, taken generally along section lines 4—4 of FIG. 3.

Turning now to FIGS. 1–5, a somewhat disk-shaped rotary atomizer 20 is mounted at the bottom end of the shaft 22 of a turbine rotator 24 of the general type illustrated in U.S. Pat. No. 4,275,838. Coating material is supplied through a paint feed tube (not shown) to the metal paint cup 26 of disk 20 and flows outward as the disk 20 is rotated by motor 24 through passageways 28 provided around the lower outer perimeter of paint cup 26, and across the slightly upwardly concave under surface 30 of disk 20 and is atomized from the perimetrically outer edge 32 thereof in accordance with known principles. Except for the metal paint cup 26, disk 20 is constructed generally as described in U.S. Pat. Nos. 5,622,563; 5,633,306; and, 5,662,278. Motor 24 and its associated services including high magnitude electrostatic potential 34, paint, turbine driving air 36 and exhaust 38, are generally enclosed within a relatively thin-walled resin or filled resin shroud 40. This assembly is suspended on an insulating column 42 from an overhead support (not shown) in accordance with known techniques. This installation is what would be regarded in the FM standard as an automatic installation, since it is not manipulated by an operator during ordinary operation.

During testing according to the FM standard, the area around the shroud 40 is exposed to the grounded one inch (about 2.5 cm) diameter sphere 43 while the high magnitude electrostatic potential is being supplied to service 34. Corona discharge will be apparent between the sphere 43 and the shroud 40 and disk 20 as the sphere 43 is moved over the surface of the shroud 40 and around the bottom or front end 44 of the shroud 40 in the vicinity of the disk 20. In a prior art assembly constructed as illustrated but not incorporating the invention to be described, in the region of the opening 46 in the front end 44 of the shroud 40, and around the disk 20, high energy corona discharge will be apparent. The terminals of this discharge will be a small area of the surface of the sphere 43 and the metal paint cup 26 of the disk 20, but the discharge will pass in a somewhat non-localized fashion through and/or around intervening structures such as the disk 20 and the shroud 40. It should be noted that the paint cup 26 and the shaft 22 and motor 24 are constructed from metal, and that the remainder of disk 20, including the nut 48 by which the disk 20 is retained on the threaded end of shaft 22, is constructed from one or more types of filled or unfilled resins.

In any event, the relatively high energy discharge in such prior art assemblies is occasionally enough to ignite the propane in air mixture mandated by the FM standard. This, of course, constitutes a failure under the FM standard. According to the invention, however, several resistors 50 having suitable resistances of, for example, 20 MΩ, are inserted into passageways 51 provided therefor at several, for example twelve equally spaced, locations in the wall of shroud 40 around opening 46. The leads of the resistors 50 are led out through the respective ends of the passageways 51 and the remaining volumes of the passageways 51 have filled with a suitable material, for example, a solvent resistant epoxy resin. The leads 52 which extend from the upper ends of resistors 50 are ground or otherwise finished flush with the outside surface of shroud 40 adjacent end 44, and are left exposed to atmosphere. The leads 54 which extend from the lower ends of resistors 50 are ground flush with the end edge surface of shroud 40 at end 44, and are left exposed to atmosphere.

Additionally, several resistors 60 having suitable resistances of, for example, 20 MΩ each also, are inserted into passageways 61 provided therefor at several, for example eight equally perimetrically spaced, locations around nut 48. The leads of the resistors 60 are led out through the respective ends of the passageways 61 and the remaining volumes of the passageways 61 are filled with a suitable material, for example, a solvent resistant epoxy resin. The leads 62 which extend from the upper ends of resistors 60 are ground or otherwise finished flush with the upper surface of nut 48 facing paint cup 26, and are left exposed. The leads 64 which extend from the lower ends of resistors 60 are ground or otherwise finished flush with the lower, outwardly facing surface of nut 48, and are left exposed to atmosphere. Different resistances can be employed, and the number of resistors can be varied from the numbers illustrated. The effect of resistors 50, 60 is to locate one terminal of any corona discharge at points on the shroud 40 and the atomizer 20 which are coupled by controlled, relatively highly resistive pathways to the components, for example, shaft 22 and paint cup 26, of the assembly which are maintained at high magnitude electrostatic potentials. The purpose of the relatively high resistance of these resistors is to reduce the energies of the corona electrons below that necessary to ignite the propane-air mixture in the FM standard test.

Figure 6:
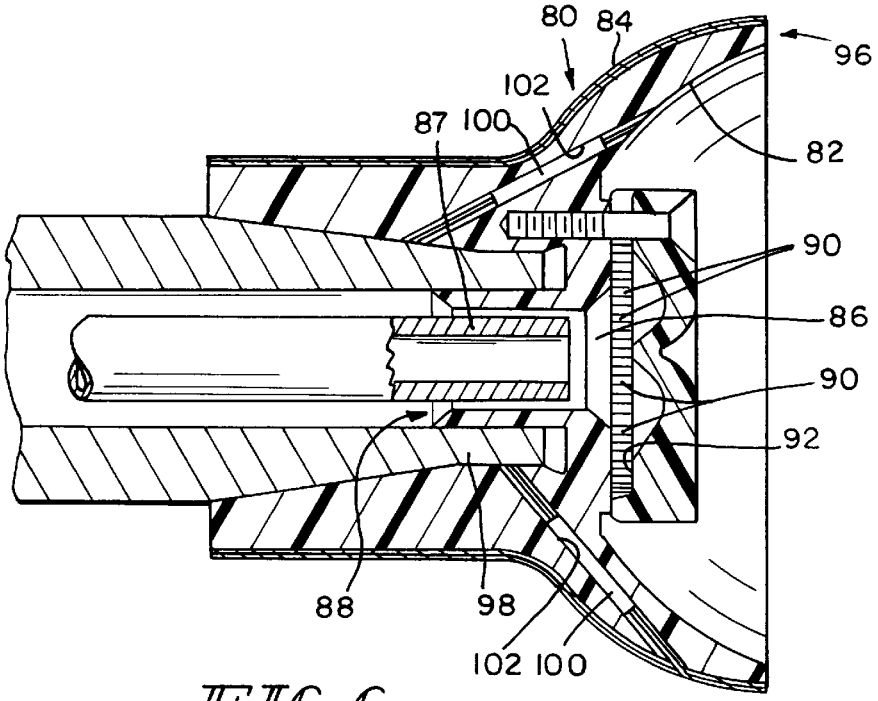
FIG. 6 illustrates a longitudinal sectional side elevational view of another apparatus constructed according to the invention; and, FIG. 7 illustrates a longitudinal sectional side elevational view of another apparatus constructed according to the invention.

In another device constructed according to the present invention, a rotary atomizer 80 (FIG. 6) includes a somewhat cup- or bell-shaped interior 82, an exterior 84, and a paint cup 86 for receiving fluid coating material supplied to the cup 86 from a feed tube 87 which extends into the paint cup 86 from the back side 88 of atomizer 80. The fluid paint is transported through openings 90 provided adjacent the bottom 92 of the cup 86 to the interior 82 of atomizer 80 and travels across interior surface 82 under the influence of centrifugal force to the atomizing edge 96 of atomizer 80. This atomizer, as described thus far, is known. See, for example, U.S. Pat. Nos. 5,622,563; 5,633,306;and, 5,662,278. However, in order to control the discharge energy of the current between the metal rotator motor shaft 98 and the feed tube 87 on the one hand and the FM standard grounded metal sphere 43 on the other hand, a number of resistors 100, for example, twelve, having any suitable value for this purpose, for example, 20 MΩ, are inserted into perimetrically equally spaced passageways 102 provided around the atomizer 80. Passageways 102 can extend from adjacent shaft 98 to the interior surface 82 of atomizer 80, or from adjacent shaft 98 to the exterior surface 84 of atomizer 80, or both. Both options are illustrated in FIG. 6. The leads of resistors 100 are led out to the ends of passageways 102. The passageways 102 are then filled with an appropriate material, such as a solvent-resistant epoxy resin or the like, and the leads of resistors 100 are then ground or otherwise finished flush with the surface of atomizer 80 adjacent shaft 98 and with surface 82 or surface 84, respectively.

Figure 7:
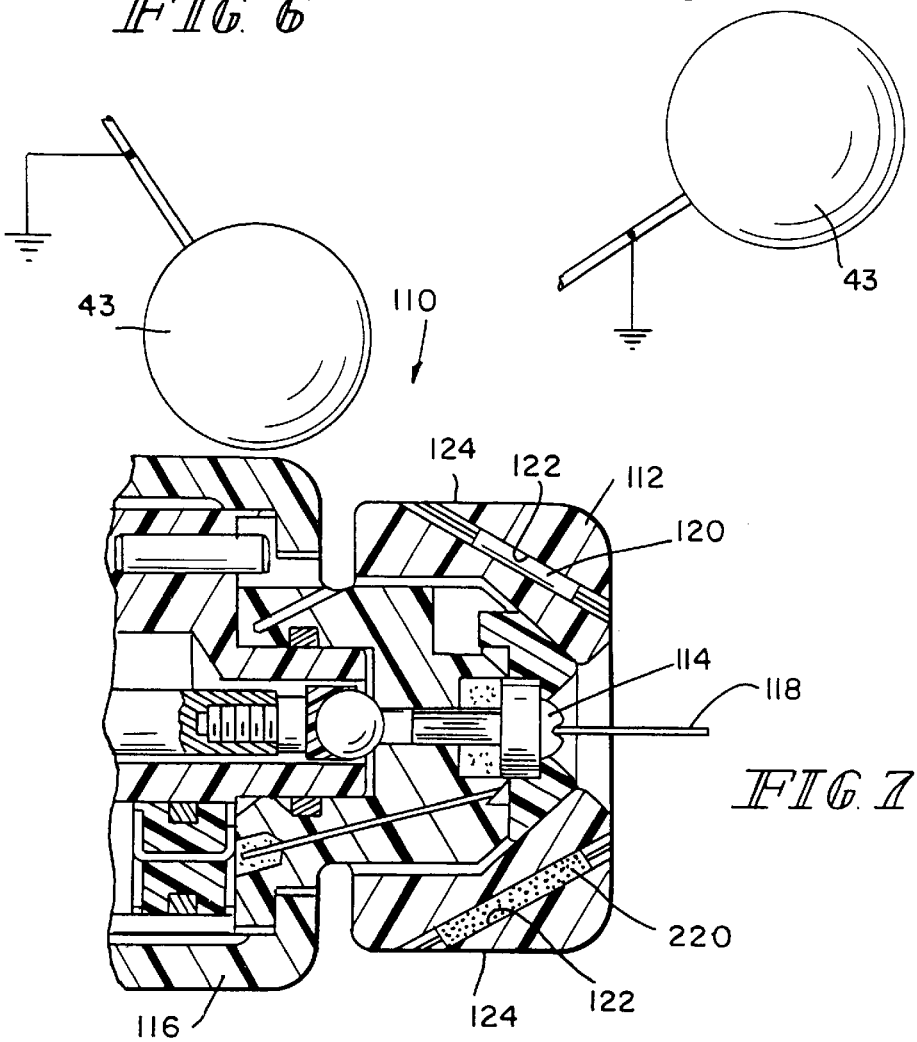

In another device constructed according to the present invention, a nozzle-type atomizer, such as a so called air atomizing or hydraulic atomizing gun 110 (FIG. 7), is provided with a nut 112 for, inter alia, fixing the nozzle 114 to the gun body 116. The nozzle is provided with a charging electrode 118 which projects forward from the gun 110 in the general location of the stream of atomized coating material projected forward from the nozzle. This atomizer, as described thus far, is known See, for example, U.S. Pat. No. 3,815,820. However, in order to control the discharge energy of the current between the electrode 118 and the FM standard grounded metal sphere 43, a number of resistors 120, for example, eight, having any suitable value for this purpose, for example, 20 MΩ, are inserted into perimetrically equally spaced passageways 122 provided around the atomizer 110. Passageways 122 extend from adjacent electrode 118 to the exterior surface 124 of nut 112 rearwardly from nozzle 114. The leads of resistors 120 are led out to the ends of passageways 122. The passageways 122 are then filled with an appropriate material, such as a solvent-resistant epoxy resin or the like, and the leads of resistors 120 are then ground or otherwise finished flush with the surface of atomizer 110.

As previously noted the values of the resistors may vary to suit the needs of a particular application. Additionally, the resistors need not necessarily be axial lead-type resistors. Other types of resistors may serve adequately in other embodiments. The resistors need not be lumped components at all. For example, a suitably semiconductive solvent-resistant paste, semiconductive film-forming material, or the like can be applied to the passageways 51, 61, 102, 122 or to the surface of, for example, shroud 40 adjacent end 44. Where, for example, a paste is applied to the passageways 51, 61, 102, 122, the paste is dried and ground or otherwise finished flush with the relevant atomizer surfaces to provide the desired resistance between the surfaces at the location of each such resistor. This option is illustrated at 220 in FIG. 7. Where a semiconductive film is applied to a surface to form a resistor, the film may be trimmed or scratched off to provide the desired resistance.

An added benefit of this invention is that the resistors inevitably become electrostatically charged to voltages having the same sign as the electrostatic potential supply 34. The resistors thus serve to repel the charged particles of coating material being atomized by the apparatus and thereby reduce the deposition of such particles on the apparatus itself.

What is claimed is:

1. An atomizing apparatus comprising a rotator having a conductive output shaft, an atomizer for mounting on the output shaft, the atomizer including an electrode coupled to the output shaft when the atomizer is mounted on the output shaft for transferring charge from the output shaft to coating material to be atomized by the apparatus, an orifice through which coating material to be atomized is discharged so that the coating material flows across the electrode and is charged, a power supply for maintaining across the electrode and an article to be coated by the atomized coating material a potential for transferring charge to the coating material to cause the coating material to be attracted toward the article, the atomizer having a first, concave, somewhat cup-shaped surface, and at least one first resistance, each first resistance having a first terminal adjacent the first surface and a second terminal adjacent at least one of the output shaft and the electrode.

2. The apparatus of claim 1 wherein the first surface comprises a non-conductive first surface.

3. The apparatus of claim 2 wherein the first surface includes a discharge edge from which the electrically charged material is atomized and discharged.

4. The apparatus of claim 3 wherein the at least one first resistance comprises at least one first lumped resistor.

5. The apparatus of claim 3 wherein the at least one first resistance comprises electrically non-insulative material, the atomizer comprising at least one first resistance passageway extending from adjacent the first surface to adjacent at least one of the output shaft and the electrode, the electrically non-insulative material being provided in the at least one first resistance passageway.

6. The apparatus of claim 3 and further comprising a shroud for housing the rotator, the shroud including a second surface, an inner edge of the second surface defining an opening through which at least a portion of the atomizer including the discharge edge extends, the shroud further including a third surface, and at least one second resistance, each second resistance having a first terminal adjacent the second surface and a second terminal adjacent the third surface.

7. The apparatus of claim 6 wherein the at least one second resistance comprises at least one second lumped resistor.

8. The apparatus of claim 6 wherein the at least one second resistance comprises electrically non-insulative material, the shroud comprising at least one second resistance passageway extending from adjacent the second surface to adjacent the third surface, the electrically non-insulative material being provided in the at least one second resistance passageway.

9. The apparatus of claim 1 wherein the atomizer further comprises a second, convex, somewhat bell-shaped, electrically non-conductive surface, and at least one second resistance, each second resistance including a first terminal adjacent the second surface and a second terminal adjacent at least one of the output shaft and the electrode.

10. The apparatus of claim 9 wherein the at least one first resistance comprises at least one second lumped resistor.

11. The apparatus of claim 9 wherein the at least one second resistance comprises electrically non-insulative material, the atomizer comprising at least one second resistance passageway extending from adjacent the second surface to adjacent the at least one of the output shaft and the electrode, the electrically non-insulative material being provided in the at least one second resistance passageway.

12. The apparatus of claim 9 wherein the first surface comprises a non-conductive first surface.

13. The apparatus of claim 12 wherein the first surface includes a discharge edge from which the electrically charged material is atomized and discharged.

14. The apparatus of claim 13 and further comprising a shroud for housing the rotator, the shroud including a third surface, an inner edge of the third surface defining an opening through which at least a portion of the atomizer including the discharge edge extends, the shroud further including a fourth surface, and at least one third resistance, each third resistance having a first terminal adjacent the third surface and a second terminal adjacent the fourth surface.

15. A coating material atomizing gun comprising an electrode, an orifice through which coating material to be atomized is discharged past the electrode so that the coating material is charged, a power supply for maintaining across the electrode and an article to be coated by the atomized coating material a potential for transferring charge to the coating material to cause the coating material to be attracted toward the article, a somewhat cylindrical, outer first surface, a second, front surface in which the electrode and the orifice are provided, the second surface being axially forward and radially inward from the first surface, and at least one first resistance, each first resistance including a first terminal at the first surface and a second terminal at the second surface.

16. The apparatus of claim 15 wherein the at least one first resistance comprises at least one first lumped resistor.

17. The apparatus of claim 15 wherein the at least one first resistance comprises electrically non-insulative material, the atomizer comprising at least one first resistance passageway extending from adjacent the first surface to adjacent at least one of the orifice and the electrode, the electrically non-insulative material being provided in the at least one first resistance passageway.

18. An atomizing apparatus comprising a rotator having a conductive output shaft, an atomizer for mounting on the output shaft, the atomizer including an electrode coupled to the output shaft when the atomizer is mounted on the output shaft for transferring charge from the output shaft to coating material to be atomized by the apparatus, an orifice through which coating material to be atomized is discharged so that the coating material flows across the electrode and is charged, a power supply for maintaining across the electrode and an article to be coated by the atomized coating material a potential for transferring charge to the coating material to be attracted toward the article, the atomizer having a first, concave, somewhat cup-shaped surface adjacent the electrode across which the coating material flows, the first surface including a discharge edge from which the electrically charged coating material is atomized and discharged, a nut for mounting the atomizer on the output shaft, the nut having a first side substantially enclosing the first surface and the electrode except for the discharge edge of the first surface when the nut is in position on the shaft retaining the atomizer thereon and a second side generally opposite the first side, and at least one first resistance, each first resistance having a first terminal adjacent the second side and a second terminal adjacent at least one of the output shaft and the electrode.

19. The apparatus of claim 18 wherein the at least one first resistance comprises at least one first lumped resistor.

20. The apparatus of claim 18 wherein the at least one first resistance comprises electrically non-insulative material, the nut comprising at least one first resistance passageway extending from adjacent the second surface to adjacent the at least one of the shaft and electrode, the electrically non-insulative material being provided in the at least one first resistance passageway.

21. The apparatus of claim 18 and further comprising a shroud for housing the rotator, the shroud including a second surface, an inner edge of the second surface defining an opening through which at least a portion of the atomizer including the discharge edge extends, the shroud further including a third surface, and at least one second resistance, each second resistance having a first terminal adjacent the second surface and a second terminal adjacent the third surface.

22. The apparatus of claim 21 wherein the at least one second resistance comprises at least one second lumped resistor.

23. The apparatus of claim 21 wherein the at least one second resistance comprises electrically non-insulative material, the nut comprising at least one second resistance passageway extending from adjacent the second side to adjacent the at least one of the electrode and the shaft, the electrically non-insulative material being provided in the at least one second resistance passageway.

* * * * *